US005988411A

United States Patent [19]

Singer et al.

[11] Patent Number: 5,988,411

[45] Date of Patent: *Nov. 23, 1999

[54] METHOD AND APPARATUS FOR REDUCED VIBRATION OF HUMAN OPERATED MACHINES

[75] Inventors: Neil C. Singer, Armonk; Bert Whitney Rappole, III, New York, both of N.Y.

[73] Assignee: Convolve, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/626,135

[22] Filed: Apr. 5, 1996

[51] Int. Cl.[6] ..... B66L 13/06

[52] U.S. Cl. ..... 212/275; 318/443; 340/685

[58] Field of Search ..... 340/685; 212/275, 212/285, 281; 318/443

[56] References Cited

U.S. PATENT DOCUMENTS

| | | | |
|---|---|---|---|
| 3,023,351 | 2/1962 | McLane et al. | 318/443 |
| 3,089,993 | 5/1963 | Wickerham et al. | 318/443 |
| 3,107,322 | 10/1963 | King | 318/443 |
| 3,280,399 | 10/1966 | Kreinberg | 318/443 |
| 4,361,312 | 11/1982 | Schreyer et al. | 254/276 |
| 4,496,883 | 1/1985 | Eascott et al. | 318/443 |
| 4,636,962 | 1/1987 | Broyden et al. | 212/281 |
| 4,997,095 | 3/1991 | Jones et al. . | |
| 5,490,601 | 2/1996 | Heissat et al. | 212/275 |

FOREIGN PATENT DOCUMENTS

| | | | |
|---|---|---|---|
| 2300093 | 12/1990 | Japan | 212/275 |
| 94/11293 | 5/1994 | WIPO | 212/275 |

*Primary Examiner*—Thomas J. Brahan
*Attorney, Agent, or Firm*—Choate, Hall & Stewart

[57] ABSTRACT

Tele-operated machine including a moveable structure and a control device functionally connected to the moveable structure for operation by a human operator. An input processor apparatus responsive to the control device generates signals to move the moveable structure in a reduced vibration fashion. In a preferred embodiment, the tele-operated machine is a crane. The operator can cause fixed length incremental movements of a load supported by the crane to be accomplished with reduced levels of vibration after the move is completed.

10 Claims, 2 Drawing Sheets

METHOD AND APPARATUS FOR REDUCED VIBRATION OF HUMAN OPERATED MACHINES

BACKGROUND OF THE INVENTION

This invention relates to human operated machines in which unwanted dynamics or vibrations are reduced. Human operated (or tele-operated) machines such as cranes are difficult to control because motion of the crane will usually result in vibration or swing of a payload supported by the crane. An example is an overhead crane which traverses a track supporting a load on a flexible member such as wire rope. The operator, using a pendant controller, causes the crane to move by energizing electric motors. Once the change in position occurs, the operator must wait until the swing oscillations decay before proceeding to the next operation. Small moves exacerbate the situation because the amplitude of the swing of the payload may be nearly equal to the total move distance. For example, a four inch move at the location of the crane hoist would result in a nearly four inch oscillation at the load. If several small moves are required, the time required for the oscillations to decay from each move will decrease overall efficiency of the operation. The elimination or reduction in load oscillation for small position adjustments (or moves) will therefore increase the speed and efficiency of crane operation.

It is known to use vibration reducing algorithms in a crane context. The known technology, however, does not suggest incremental moves with reduced vibration and the algorithms lack robustness with respect to errors in system parameters such as natural frequency and damping ratio.

SUMMARY OF THE INVENTION

A tele-operated machine according to the invention, in a first aspect, includes a moveable structure and a control device functionally connected to the moveable structure for operation by a human operator. An input processing apparatus is responsive to the control device to generate input signals to move the moveable structure in a reduced vibration fashion. In one preferred embodiment, the tele-operated machine is a crane. In this embodiment, the preferred motion of the crane is a series of preselected moves of finite or incremental amount. The control device includes an input control wherein the finite motion is initiated by a momentary actuation of the input control. It is preferred that the control device be switchable between a vibration reduced fixed length move and a move proportional to the human operator's input. The input processing device comprises computing apparatus for determining an input which eliminates vibration of the load at its natural frequencies. If the vibration reducting technique uses a sequence of pulses or impulses, apparatus may be provided for convolving this sequence with an arbitrary command input to shape the input so that the load moves with reduced vibration.

In another aspect, the invention is a crane having a moveable portion adapted to support a load and control device functionally connected to the moveable portion for operation by a human operator. Input processing apparatus responsive to the control device generates input signals to move the moveable portion in a reduced vibration fashion. It is preferred that the crane controller include a button or switch upon momentary activation of which the crane will move approximately a preselected finite amount (incremental motion) with reduced vibration. Further, the reduced vibration mode may be permanently activated by depressing a sequence of buttons or activating a separate switch. In one embodiment, the human operator activates a button switch twice quickly (like double clicking on a computer mouse) to cause the crane to be in a fixed length move mode so that all future button pushes result in fixed length jogs with reduced vibration. In this embodiment, the user deactivates the fixed length move mode by again double pushing the button switch.

DESCRIPTION OF THE PREFERRED EMBODIMENT

The present invention is compatible with any existing vibration reducing algorithm when used in an incremental motion mode as disclosed herein. One suitable algorithm for use in the incremental motion mode of the invention is described by J. P. Feddema in "Digital Filter Control of Remotely Operated Flexible Robotic Structures", 1993 ACC, San Francisco, Calif. Vol. 3, pp. 2710–2715. In another aspect, the present invention makes use of technology disclosed in U.S. Pat. No. 4,916,635 and U.S. patent application Ser. No. 08/259,880, filed Jun. 15, 1994 and entitled "Method and Apparatus for Minimizing Unwanted Dynamics in a Physical System." The teachings in this patent and pending application are hereby incorporated herein by reference. The '635 patent discloses methods and apparatus for shaping an arbitrary command input to a dynamic physical system to reduce endpoint vibration. As set forth in the patent, the apparatus includes computing apparatus for determining an input sequence which eliminates vibration of the dynamic physical system at its natural frequencies and apparatus for convolving the impulse sequence with the arbitrary command input to shape the input. Apparatus is provided for controlling the physical system based on the shaped command input to the dynamic physical system.

Figure 1:
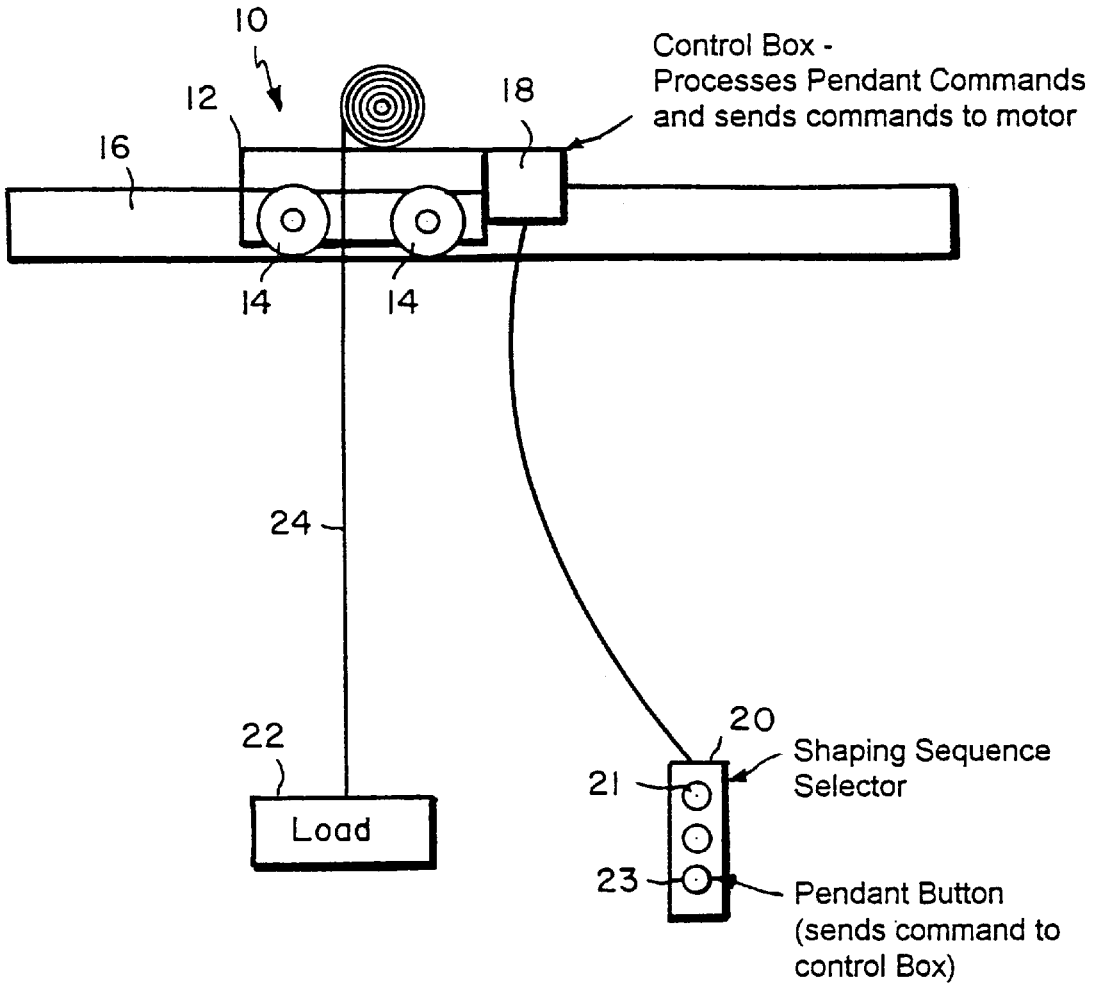
FIG. 1 is a schematic diagram of an overhead crane embodying the invention disclosed herein.

With respect now to FIG. 1, a crane system 10 includes a moveable portion 12 supported on rollers 14. The rollers rest on a supporting structure 16. As will be appreciated by those skilled in the crane art, the rollers 14 are turned by a motor (not shown in FIG. 1) controlled by a control box 18. Oftentimes the crane system 10 will be located high above an operator. In such a case, a hand-operated pendant 20 extends from the control box 18 to the level of a human operator (not shown). Alternatively, the control box 18 may be activated by a hand-held radio controller (not shown). The crane system 10 supports a load 22 through a flexible member 24 such as wire rope. In conventionally known overhead crane systems, the pendant 20 includes buttons or switches which when operated cause the moveable portion 12 to move forwardly or backwardly. As discussed earlier, and as will be readily appreciated, if the moveable portion 12 were to move, for example, to the left in FIG. 1 and then stop, the load 22 will oscillate at a natural frequency related to the length of the supporting member 24. The amplitude of such an oscillation could well be as large as the length of a small move such as a one-inch move. The input shaping circuitry according to the invention may be included in the pendant 20, in the control box 18 or in some other remote location.

Figure 2:
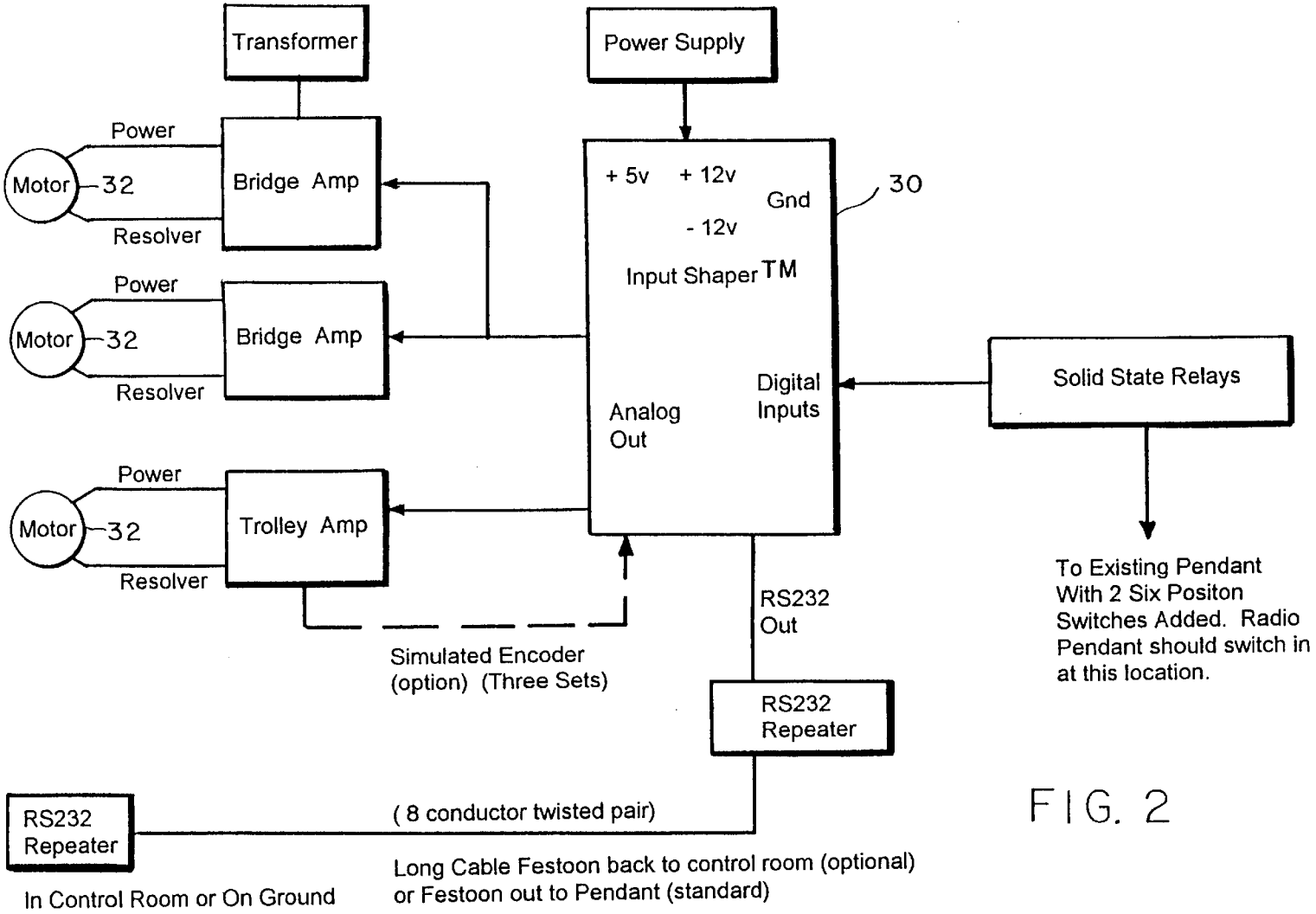
FIG. 2 is a block diagram of a system for operating the crane of FIG. 1.

FIG. 2 is a block diagram of an embodiment of the present invention. In this embodiment, the selected input processing technology is included in block 30. Inputs from the pendant 20 (FIG. 1) are processed by the input processor in the block 30 to generate signals which operate one or more of the motors 32. The technology disclosed in U.S. Pat. No. 4,916,635 is preferred because this technology is robust with respect to errors in knowledge of the physical parameters of the system. To use the teachings of the '635 patent, the natural frequency and damping ratio of the crane/load system are estimated for its range of operation. These parameters are used to determine the appropriate impulse sequence which is then convolved with an arbitrary command input (such as, for example, a fixed length move) to process the input to drive the rollers 14 to move the structure 16 in a way to reduce oscillation of the load 22. Because of robustness, vibration is reduced even in the presence of errors in the estimate of natural frequency and damping ratio. Such robustness is not present in some other input processing algorithms.

The operation of the crane system 10 will now be described. The present invention can be used in conjunction with, or in addition to, the conventionally known pendant 20. In a presently preferred embodiment, the pendant 20 includes a shaping sequence selector button 21 and multiple pendant buttons 23.

Under normal crane operation, the operator holds down the pendant button 23 and the crane responds by moving for as long as the button is pressed. In this embodiment, a new incremental mode would be available that, when activated, results in the crane indexing approximately a prescribed distance. This new mode could be activated by either quickly pressing and releasing the pendant button 23 or by selecting a mode with another switch, such as selector 21. The payload would move the incremental amount without vibration. The incremental moves could be repeated. For example, to move the payload one inch with a preselected increment of ¼ inch would require four presses of the button. Additionally, the incremental distance could be changed by using a selector switch.

In another mode of operation, the reduced vibration incremental mode may be activated permanently by executing a sequence of button pushing operations or moving a separate switch. For example, in one mode, the user presses the button 21 or 23 twice quickly (like double clicking on a computer mouse) so that the crane would then be in a fixed length move incremental mode and all subsequent button pushes result in fixed length jogs until the user deactivates the mode by once again double pushing the button 21.

The present invention allows a human operated crane or other machine to perform incremental moves with reduced vibration. In a crane embodiment, the user can select between conventional control in which motion is proportional to the human operator's input, or in the incremental mode in which preselected fixed length moves are accomplished with reduced endpoint vibration. While the preferred embodiment has been described in conjunction with an overhead crane, it should be noted that the present invention is applicable for use with any tele-operated machinery and it is intended that the appended claims cover any such uses.

What is claimed is:

1. Tele-operated machine comprising:

a movable structure;

a control device functionally connected to the moveable structure for operation by a human operator; and input processing apparatus responsive to the control device to shape an input to generate signals to move the moveable structure incrementally in a reduced vibration fashion a preselected finite distance per actuation by the human operator.

2. The machine of claim 1 wherein the moveable structure is a crane.

3. The machine of claim 1 wherein the control device includes an input control wherein the finite incremental motion is initiated by a momentary actuation of the input control.

4. The machine of claim 1 wherein the control device is switchable between the reduced vibration finite distance move and a move proportional to the human operator's input.

5. The machine of claim 1 wherein the input processing apparatus comprises:

apparatus for convolving a previously determined impulse sequence with an arbitrary command input to shape the input; and apparatus for controlling the movable structure based on a shaped command input.

6. Crane comprising:

a moveable portion adapted to support a load;

a pendant functionally connected to the moveable portion for operation by a human operator; and input processing apparatus responsive to the control device to shape an input to generate signals to move the moveable structure incrementally in a reduced vibration fashion a preselected finite distance per actuation by the human operator.

7. The crane of claim 6 wherein the control device includes an input control wherein the finite motion is initiated by a momentary activation of the input control.

8. The crane of claim 6 wherein the incremental motion mode is initiated with the selector switch.

9. The crane of claim 8 wherein the incremental motion mode is initiated by a double activation of the selector switch.

10. Crane comprising:

a moveable portion adapted to support a load;

a pendant functionally connected to the moveable portion for operation by a human operator;

apparatus for convolving a previously determined impulse sequence with an arbitrary command input to shape the input; and apparatus for controlling the moveable portion to move incrementally a preselected finite distance per actuation of the pendant by the human operator based on the shaped input for reduced vibration.

* * * * *